United States Patent [19]

Pebdani et al.

[11] Patent Number: 4,565,249

[45] Date of Patent: Jan. 21, 1986

[54] HEAVY OIL RECOVERY PROCESS USING CYCLIC CARBON DIOXIDE STEAM STIMULATION

[75] Inventors: Farrokh N. Pebdani, Coppell; Winston R. Shu, Dallas, both of Tex.

[73] Assignee: Mobil Oil Corporation, New York, N.Y.

[21] Appl. No.: 652,541

[22] Filed: Sep. 20, 1984

Related U.S. Application Data

[63] Continuation-in-part of Ser. No. 561,407, Dec. 14, 1983, abandoned.

[51] Int. Cl.[4] ..... E21B 43/24

[52] U.S. Cl. ..... 166/303

[58] Field of Search ..... 166/272, 303

[56] References Cited

U.S. PATENT DOCUMENTS

| | | | |
|---|---|---|---|
| 3,477,510 | 11/1969 | Spillette | 166/272 |
| 3,782,470 | 1/1974 | West et al. | 166/303 |
| 4,085,803 | 4/1978 | Butler | 166/303 |
| 4,099,568 | 7/1978 | Allen | 166/272 X |
| 4,217,956 | 8/1980 | Goss et al. | 166/303 X |
| 4,257,650 | 3/1981 | Allen | 299/2 |
| 4,271,905 | 6/1981 | Redford et al. | 166/303 X |
| 4,429,745 | 2/1984 | Cook | 166/263 |

*Primary Examiner*—George A. Suchfield

*Attorney, Agent, or Firm*—Alexander J. McKillop; Michael G. Gilman; Charles J. Speciale

[57] ABSTRACT

A method for the recovery of viscous oil from subterranean formations including tar sands by the injection of a mixture of carbon dioxide and steam into the formation through an injection well, after which formation fluids are recovered from the well in a cyclic manner, using the well alternately for injection and production. Incremental recovery is optimized by maintaining the ratio of carbon dioxide to steam within the range 200 to 300, preferably 230 to 270 SCF carbon dioxide per barrel of steam (with water equivalent) in the injected mixture.

8 Claims, 1 Drawing Figure

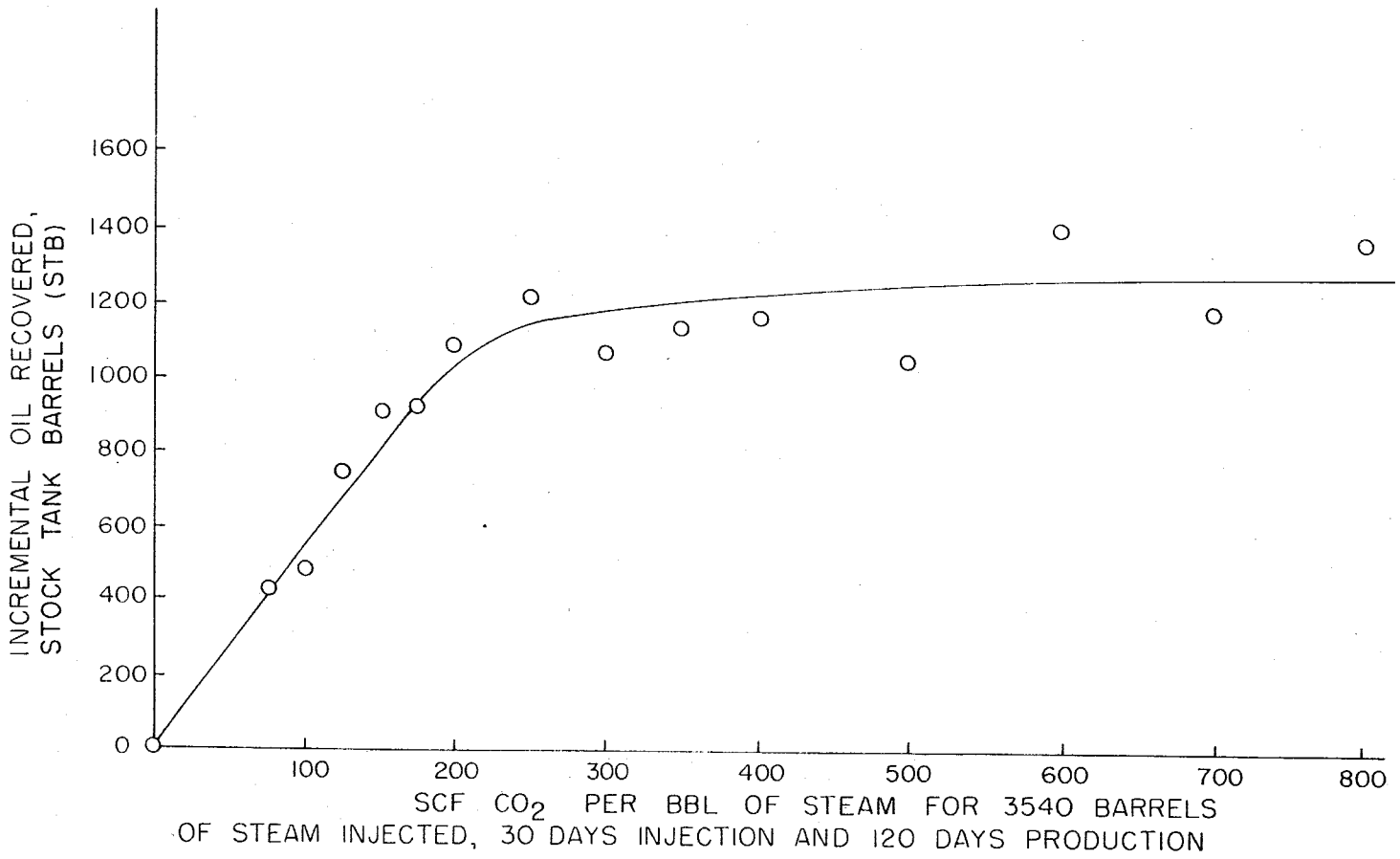
INCREMENTAL OIL RECOVERED, STOCK TANK BARRELS (STB)
0
200
400
600
800
1000
1200
1400
1600
100
200
300
400
500
600
700
800
SCF $CO_2$ PER BBL OF STEAM FOR 3540 BARRELS OF STEAM INJECTED, 30 DAYS INJECTION AND 120 DAYS PRODUCTION

HEAVY OIL RECOVERY PROCESS USING CYCLIC CARBON DIOXIDE STEAM STIMULATION

CROSS REFERENCE TO RELATED APPLICATIONS

This application is a continuation-in-part of Application Ser. No. 561,407, filed Dec. 14, 1983, now abandoned.

FIELD OF THE INVENTION

This invention relates to a method for the recovery of oil from oil-bearing formations containing viscous oils or bitumen. More particularly, the invention relates to a method for the recovery of oil from a subterranean, viscous oil-containing formation penetrated by at least one well by injecting a mixture of carbon dioxide and steam.

BACKGROUND OF THE INVENTION

The recovery of low API gravity or viscous oil from subterranean oil-bearing formations and bitumen from tar sands has generally been difficult. Although some improvement has been realized in the recovery of heavy oils, i.e., oils having an API gravity in the range of 10° to 25° API, little success has been realized in recovering bitumen from tar sands. Bitumen can be regarded as a highly viscous oil having an API gravity in the range of about 5° to about 10 ° API and a viscosity in the range of several million centipoise at formation temperature. Bitumens of this kind may be found in essentially unconsolidated sands, generally referred to as tar sands, of which there are extensive deposits in the Athabasca region of Alberta, Canada. While these deposits are estimated to contain about several hundred billion barrels of bitumen, recovery from them, as indicated above, using conventional techniques has not been altogether successful. The reasons for the varying degrees of success arise principally to the fact that the bitumen is extremely viscous at the temperature of the formation, with consequent very low mobility. In addition, the tar sand formations have very low permeability, despite the fact they are unconsolidated.

Because the viscosity of viscous oils decreases markedly with increases in temperature, thermal recovery techniques have been investigated for recovery of bitumen from tar sands. These thermal recovery methods generally include steam injection, hot water injection and in-situ combustion.

Typically, such thermal techniques employ an injection well and a production well transversing the oil-bearing or tar sand formation. In a conventional throughput steam operation, steam is introduced into the formation through an injection well. Upon entering the formation, the heat transferred to the formation by the hot aqueous fluid lowers the viscosity of the formation oil, thereby improving its mobility. In addition, the continued injection of the hot aqueous fluid provides a drive to displace the oil toward the production well from which it is produced.

Thermal techniques employing steam also utilize a single well technique, known as the "huff and puff" method, such as described in U.S. Pat. No. 3,259,186. In this method, steam is injected via a well in quantities sufficient to heat the subterranean hydrocarbon-bearing formation in the vicinity of the well. The well is then shut-in for a soaking period, after which it is placed on production. After projection has declined, the "huff and puff" method may again be employed on the same well to again stimulate production.

The application of single well schemes employing steam injection and as applied to heavy oils or bitumen is described in U.S. Pat. No. 2,881,838, which utilizes gravity drainage. An improvement of this method is described in a later patent, U.S. Pat. No. 3,155,160, which steam is injected and appropriately timed pressuring and depressuring steps are employed. Where applicable to a field pattern, the "huff and puff" technique may be phased so that numerous wells are on an injection cycle while others are on a production cycle; the cycles may then be reversed.

U.S. Pat. No. 4,257,650 describes a method for recovering high viscosity oils from subsurface formations using steams and an inert gas to pressurize and heat the formation and the oil which it contains. The steam and the inert gas may be injected either simultaneously or sequentially, e.g. steam injection, followed by a soak period, followed by injection of inert gas. Inert gases referred to include helium, methane, carbon dioxide, flue gas, stack gas and other gases which are noncondensable in character and which do not interact either with the formation matrix or the oil or other earth materials contained in the matrix.

Injection of $CO_2$ with steam during cyclic steam stimulation of heavy oil reservoirs has received attention recently. Carbon dioxide dissolves in the oil easily and causes viscosity reduction, and swelling of the oil which in turn leads to additional oil recovery. Recent simulation studies by Leung, L. C., "Numerical Evaluation of the Effect of Simultaneous Steam and $CO_2$ Injection on the Recovery of Heavy Oil", *J. Pet. Tech.*, p. 1591 (September 1983), and Redford, D. A., "The Use of Solvents and Gases with Steam in the Recovery of Bitumen from Oil Sands", *J. Can. Pet. Tech.*, p. 45, (January-February 1982), confirm the benefit of $CO_2$-steam co-injection into heavy oil reservoirs. The Leung article discloses six cycles of steam stimulation, each with a 40,000 barrel steam (cold water equivalent) slug of steam injected in 40 days, as the base case. Three separate carbon dioxide runs with 200, 400, and 600 SCF carbon dioxide/bbl of steam were used for comparison. A 36% improvement in recovery was observed for the 400 SCF/bbl case, where majority of the incremental oil was obtained in the first three cycles of stimulation. After one cycle, Leung's results show that the optimum carbon dioxide slug size was 400 SCF of carbon dioxide per barrel of steam (cold water equivalent).

In the Redford article cited above, the effect of injecting different solvents and gases including carbon dioxide on recovery of Athabasca bitumen from an oil sand pack penetrated by one injection well and one production well was investigated. The results showed that $CO_2$ an ethane gas gave improvements in recovery over the other additives, and that the majority of the improvement occurred in the pressure drawdown phases of the experiment. Larger swept volumes resulted from addition of ethane and $CO_2$ and substantially cooler fluids (non-thermally driven) were produced. An optimum $CO_2$-steam ratio was noted to exist at about 35-$dm^3$ $CO_2$/kg steam or 197 SCF/bbl, assuming standard conditions. Undesirable effects of using too much gas were thought to be caused by reduced injectivity, reduced permeability to liquids and an increased tendency towards channeling of steam.

The present invention discloses an improvement in the $CO_2$-steam cyclic process in which recovery is maximized by injection of a mixture of carbon dioxide and steam.

SUMMARY OF THE INVENTION

The present invention relates to a method of recovery oil from a subterranean, viscous oil-containing formation penetrated by at least one well in fluid communication with a substantial portion of the formation, comprising injecting a mixture of cabon dioxide and steam and thereafter recovering fluids including oil from the formation through the well. The ratio of injected carbon dioxide to steam is maintained in the range of 200 to 300 SCF carbon dioxide per barrel of steam (cold water equivalent), preferably about 230 to 270 SCF per barrel.

THE DRAWING

The drawing shows the relationship between the incremental oil recovered and $CO_2$:steam ratio in the simulation described below.

DETAILED DESCRIPTION

In its broadest aspect, this invention relates to a $CO_2$-steam push-pull or "huff and puff" stimulation method for the recovery of viscous oil from a subterranean viscous oil-containing formation utilizing a specific ratio of cabon dioxide to steam to obtain maximum oil recovery.

A relatively thick, subterranean viscous oil-contaning formation such as a heavy oil or tar sand formation is penetrated by a single well in fluid communication with a substantial portion of the formation by means of perforations. A predetermined amount of a mixture of carbon dioxide and steam maintained at a ratio of carbon dioxide to steam of about 200 to 300, preferably 230 to 270 SCF carbon dioxide per barrel of steam (cold water equivalent) is injected into the formation via the well. The preferred amount of carbon dioxide relative to the steam is about 250 carbon dioxide per barrel of steam (CWE). It is preferred that the commingled steam be saturated steam having a quality in the range of 50% to about 85% and a temperature within the range of 400° to 650° F. The amount of steam injected with the carbon dioxide is preferably about 180 barrels (cold water equivalent) per foot of net pay and the injection rate is preferably 6 barrels (cold water equivalent) per day per foot of net pay.

After a predetermined amount of the carbon dioxide-steam mixture has been injected into the formation, injection of the carbon dioxide steam mixture is terminated, the well is opened and fluids including oil are allowed to flow from the formation into the well from which they are recovered. Production of fluids including oil is continued until the amount of oil recovered is unfavorable. The cycle of injection of $CO_2$-steam and production may be repeated as many times as is practical and economical. After injection of the $CO_2$-steam mixture, the well may be shut-in for a soak-period prior to production to allow the steam and carbon dioxide to "soak" or remain in the formation in order to obtain maximum transfer of thermal energy and viscosity reduction from the injected fluids to the viscous oil and the formation matrix. The length of the soak period will vary depending upon characteristics of the formation and the amount of $CO_2$-steam injected.

EXPERIMENTAL

Utilizing computer simulations, a well was sunk into a reservoir 20 feet thick, containing a heavy crude of 10.9° API and 61900 cp at 55° F. A straight steam run was first made for comparison with subsequent runs utilizing various mixtures of carbon dioxide and steam.

Saturated steam having a 70% quality and a temperature of 590° F. was injected into the reservoir at an injection rate of 118 barrels of steam (cold water equivalent) per day for 30 days (total of 3540 barrels of steam injected), after which the well was turned around and produced for 120 days. Thereafter, runs utilizing mixtures of carbon dioxide and steam at ratios varying from 100 to 800 SCF of cabon dioxide per barrel of steam (cold water equivalent) were made and the amount of oil recovered was compared with the amount of oil recovered using steam only. In each case, the amount of steam injected (3540 barrels) and the injection and production times (30 days, 120 days) were maintained constant.

The results from these runs are shown in the accompanying drawing in which the incremental oil recovered, i.e. the difference between recovery of oil using straight steam and recovery of oil using a specific ratio of carbon dioxide to steam, is plotted against the carbon dioxide/steam ratio (SCF per barrel). It can be seen that the incremental recovery increases approximately linearly up to a ratio of about 250 SCF cabon dioxide per barrel of steam, after which incremental recovery was approximately constant. The results therefore show that optimum oil recovery is realized when the carbon dioxide to steam ratio is about 250 SCF carbon dioxide per barrel of steam (cold water equivalent). Additional amounts of carbon dioxide do not significantly enhance oil recovery, thereby only resulting in additional costs of carbon dioxide.

What is claimed is:

1. A method of recovering oil from a subterranean, viscous oil-containing formation penetrated by at least one well in fluid communication with a substantial portion of the formation, comprising:

(i) injecting a mixture of carbon dioxide and steam into the formation through the well, the ratio of carbon dioxide to steam being from 200 to 300 SCF carbon dioxide per barrel of steam (cold water equivalent); and (ii) recovering fluids including oil from the formation through the well.

2. The method of claim 1 wherein steps (i) and (ii) are repeated for a plurality of cycles.

3. The method of claim 1 wherein the temperature of the steam is in the range of 400° F. to 650° F.

4. The method of claim 1 wherein the amount of steam injected with the cabon dioxide during step (i) is about 180 barrels of steam (cold water equivalent) per foot of net pay and the injection rate is about 6 barrels of steam (cold water equivalent) per day per foot of net pay.

5. The method of claim 1 wherein the steam quality is in the range of 50% to 85%.

6. The method of claim 1 further including the steps of shutting-in the well after step (i) to allow the formation to undergo a soak period.

7. The method of claim 1 in which the ratio of carbon dioxide to steam is from 230 to 270 SCF carbon dioxide per barrel of steam (cold water equivalent).

8. The method of claim 1 in which the ratio of cabon dioxide to steam is about 250 SCF carbon dioxide per barrel of steam (cold water equivalent).

* * * * *